US010197313B2

(12) United States Patent
Kim et al.

(10) Patent No.: US 10,197,313 B2
(45) Date of Patent: Feb. 5, 2019

(54) CONDENSER FOR REFRIGERATOR

(71) Applicant: SAMWON INDUSTRIAL CO., LTD., Gwangju (KR)

(72) Inventors: Kapyoung Kim, Gwangju (KR); Youngjin Kim, Gwangju (KR)

(73) Assignee: SAMWON INDUSTRIAL CO., LTD., Gwangju (KR)

( * ) Notice: Subject to any disclaimer, the term of this patent is extended or adjusted under 35 U.S.C. 154(b) by 255 days.

(21) Appl. No.: 14/539,537

(22) Filed: Nov. 12, 2014

(65) Prior Publication Data

US 2015/0323229 A1 Nov. 12, 2015

(30) Foreign Application Priority Data

May 9, 2014 (KR) ..... 10-2014-0055690
May 9, 2014 (KR) ..... 10-2014-0055718

(51) Int. Cl.

| | |
|---|---|
| ***F25B 39/00*** | (2006.01) |
| ***F25B 39/04*** | (2006.01) |
| ***F28D 1/053*** | (2006.01) |
| ***F28F 1/12*** | (2006.01) |

(Continued)

(52) U.S. Cl.

CPC ..... *F25B 39/00* (2013.01); *F25B 39/04* (2013.01); *F28D 1/0535* (2013.01); *F28F 1/126* (2013.01); *F28D 1/047* (2013.01); *F28D 2021/0084* (2013.01)

(58) Field of Classification Search

CPC ..... F28D 1/047; F28D 1/0475; F28D 2021/0084; F25B 39/00; F25B 39/04; F28F 1/126

See application file for complete search history.

(56) References Cited

U.S. PATENT DOCUMENTS 2,995,906 A * 8/1961 Brandimarte ..... F25D 17/067 165/124
3,638,445 A * 2/1972 Lavigne, Jr. ..... F25B 49/027 165/121

(Continued)

FOREIGN PATENT DOCUMENTS

| | | |
|---|---|---|
| JP | 2003004359 | 1/2003 |
| KR | 1020060017395 | 2/2006 |

*Primary Examiner* — Keith Raymond

*Assistant Examiner* — Gordon Jones

(74) *Attorney, Agent, or Firm* — IPLA P.A.; James E. Bame

(57) ABSTRACT

A condenser for refrigerator includes left and right or upper and lower headers spaced apart from each other for introduction or discharge of refrigerant, a tube unit including tubes mounted between the headers and spaced apart from one another to allow the refrigerant to pass through the tubes, and a fin structure mounted in the respective neighboring tubes to perform heat exchange between the refrigerant passing through the tubes and outside air, the fin structure including fins having a greater width than a width of the tubes. Providing the fins with a greater width than that of the tubes may achieve an expanded heat exchange range and higher heat exchange efficiency. Moreover, wider gaps between the fins ensure smooth air movement, causing a reduced pressure difference of the moving air and neither dust nor debris is trapped between the fins, resulting in higher heat exchange efficiency.

4 Claims, 8 Drawing Sheets

(51) Int. Cl.
*F28D 1/047* (2006.01)
*F28D 21/00* (2006.01)

(56) References Cited

U.S. PATENT DOCUMENTS 3,943,728 A * 3/1976 Maudlin ..... F25B 39/04 165/127
D403,756 S * 1/1999 Aketa ..... D23/351
6,026,891 A * 2/2000 Fujiyoshi ..... F28D 15/0233 165/104.33
6,119,767 A * 9/2000 Kadota ..... F28D 15/0233 165/104.33
9,328,973 B2 * 5/2016 Jindou ..... F28F 9/02
9,506,683 B2 * 11/2016 Katoh ..... B60H 1/00342
2007/0199686 A1 * 8/2007 Okinotani ..... F28D 1/05383 165/152
2007/0204978 A1 * 9/2007 Beamer ..... F28D 1/05366 165/124
2009/0299531 A1 * 12/2009 Kitamura ..... G05B 23/0235 700/275
2011/0036550 A1 * 2/2011 Jiang ..... F28F 1/128 165/173
2011/0139425 A1 * 6/2011 Beamer ..... F28D 1/0476 165/175

* cited by examiner

CONDENSER FOR REFRIGERATOR

CROSS REFERENCE

This application claims foreign priority under Paris Convention to Korean Patent Application Nos. 10-2014-0055718, filed 9 May 2014, and 10-2014-0055690, filed 9 May 2014, respectively with the Korean Intellectual Property Office, which are incorporated herewith in its entirety.

BACKGROUND

The present invention relates to condenser for refrigerator and, more particularly, to condenser for refrigerator in which fins have a greater width than a width of tubes, which may result in an expanded heat exchange range and higher heat exchange efficiency and ensure easy installation of the condenser even in a narrow space and efficient implementation of heat exchange.

Generally, refrigerators include a refrigeration cycle that is comprised of a compressor, a condenser, a capillary tube, an evaporator, and the like for sequential circulation of refrigerant. The compressor compresses gas-phase refrigerant into high temperature and high pressure gas-phase refrigerant and provides circulation force for the refrigerant. The compressed high temperature and high pressure gas-phase refrigerant is phase changed into room temperature and high pressure liquid-phase refrigerant while passing through the condenser via heat exchange (heat dissipation) with outside air and, subsequently, changed into low temperature and low pressure liquid-phase refrigerant while passing through the capillary tube. Then, the low temperature and low pressure liquid-phase refrigerant is again phase changed into gas-phase refrigerant via heat exchange (heat absorption) while passing through the evaporator and, thereafter, is returned to the compressor.

Among the respective constituent elements of the refrigeration cycle as described above, the condenser and the evaporator need high heat exchange efficiency.

Especially the condenser is a device that changes high temperature and high pressure gas-phase refrigerant directed from the compressor into liquid-phase refrigerant by cooling the gas-phase refrigerant and is used in a variety of refrigeration and air conditioning products, such as refrigerators, air conditioners, and the like.

To explain about additional, heat radiation occurs as gas-phase refrigerant is phase changed into liquid-phase refrigerant because the gas-phase refrigerant, which has absorbed heat through the evaporator, is cooled while passing through the condenser.

In this case, heat radiated from an outdoor unit of an air conditioner or the back of a refrigerator is generated in the condenser. High temperature and high pressure gas-phase refrigerant, introduced into an entrance of the condenser, is cooled while passing through the interior of the condenser, whereby low temperature and high pressure liquid-phase refrigerant is discharged from an exit of the condenser.

In consideration of importance of heat exchange efficiency, the condenser or the evaporator as described above is provided with a plurality of radiation fins. These radiation fins serve to increase heat radiation from high temperature and high pressure refrigerant passing therethrough, thereby contributing to enhancement in heat radiation efficiency.

However, conventional condensers or evaporators have limits to increase a heat radiation area and, consequently, to enhance heat radiation efficiency and heat exchange efficiency. Therefore, developments related thereto are needed urgently.

Meanwhile, a refrigerator functions to keep food and the like refrigerated or frozen by lowering an interior temperature thereof using cold air that is generated by a refrigeration cycle comprised of a compressor, a condenser, an expansion valve, and an evaporator.

In particular, mounted in a machine room defined in a rear bottom region of the refrigerator are the compressor that compresses low temperature and low pressure gas-phase refrigerant directed from the evaporator into high temperature and high pressure gas-phase refrigerant and the condenser that is connected to the compressor and condenses the compressed refrigerant from the compressor into room temperature and high pressure liquid-phase refrigerant.

In this case, for protection of the refrigerator's machine room in which the compressor and the condenser are mounted, the machine room is shield with a machine room cover and a blowing fan used to cool the compressor and the condenser is mounted at the outside of the machine room.

However, due to fact that both the compressor and the condenser are mounted in the machine room, the machine room as described above occupies almost all of a bottom region of the refrigerator, which causes a reduction in the volume of a usable inner space of the refrigerator proportional to the size of the machine room.

In particular, the machine room cover for protection of the compressor and the condenser is secured to the exterior of the machine room to prevent the compressor and the condenser from coming into contact with outside air. While the machine room cover has slits to allow interior heat of the machine room, i.e. heat of the compressor, heat of the refrigerant radiated around the condenser, and the like to be discharged outward, these slits of the machine room cover do not provide rapid heat radiation from the machine room, which inevitably causes increase in the interior temperature of the machine room.

SUMMARY OF THE INVENTION

Therefore, the present invention has been made in view of the problems of the related art, and it is one object of the present invention to provide a condenser for refrigerator in which fins of fin structures have a greater width than a width of tubes constituting a tube unit, which may result in an expanded heat exchange range and higher heat exchange efficiency.

It is another object of the present invention to provide a condenser for refrigerator in which a tube unit and fin structures have a U-shaped form, which may ensure installation of the condenser within a limited space and higher heat exchange efficiency.

In accordance with an aspect of the present invention, to accomplish the above and other objects, a condenser for refrigerator includes left and right or upper and lower headers spaced apart from each other, a tube unit including tubes mounted between the headers and spaced apart from one another, the tubes serving to transfer refrigerant introduced or discharged through the tubes, and a fin structure mounted in the respective neighboring tubes to perform heat exchange between the refrigerant transferred through the tubes and outside air, the fin structure including fins having a greater width than a width of the tubes.

The tube unit and the fin structure may be supported by a plurality of support members located at lower ends thereof, and the support members may be disposed on a base panel.

Each of the tubes may define a plurality of transfer path therein, and the tube unit and the fin structure may respectively have a U-shaped form.

Here, the tubes of the tube unit and the fins of the fin structure may have a U-shaped form and are vertically and horizontally stacked one above another.

The tube unit and the fin structure may define an inner space and a blowing fan may be located in the inner space.

Here, the fin structure between the respective neighboring tubes may be longitudinally corrugated and may have a pitch within a range of 2 mm to 10 mm to prevent trapping of dust.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
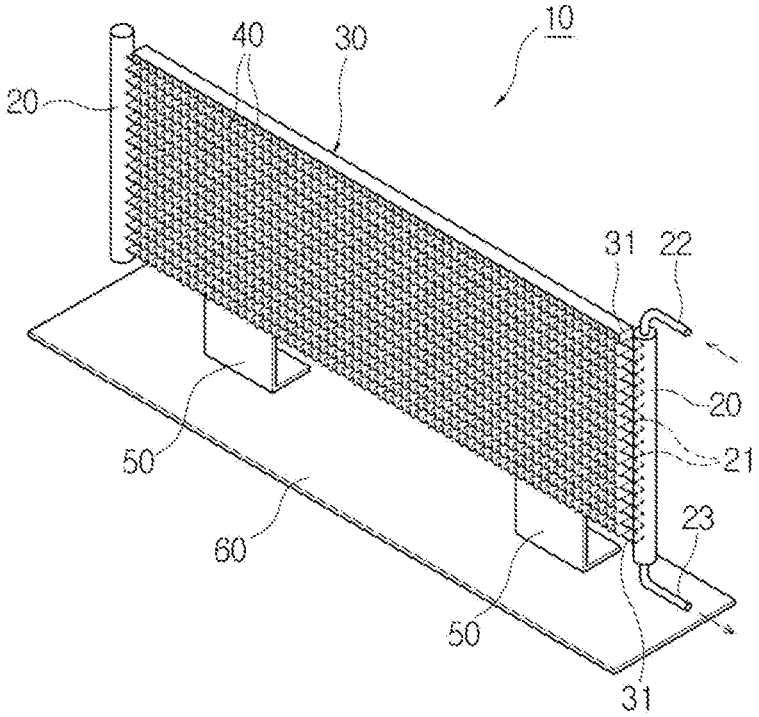
FIG. 1 is a perspective view showing a condenser for refrigerator according to the present invention.

Hereinafter, embodiments of the present invention will be described in detail with reference to the accompanying drawings to enable easy implementation of the present invention by those skilled in the art. However, the present invention may be embodied as various different schemes, and should not be limited to the embodiments described herein. Throughout the specification, the same reference numerals designate the same or similar parts.

Figure 2:
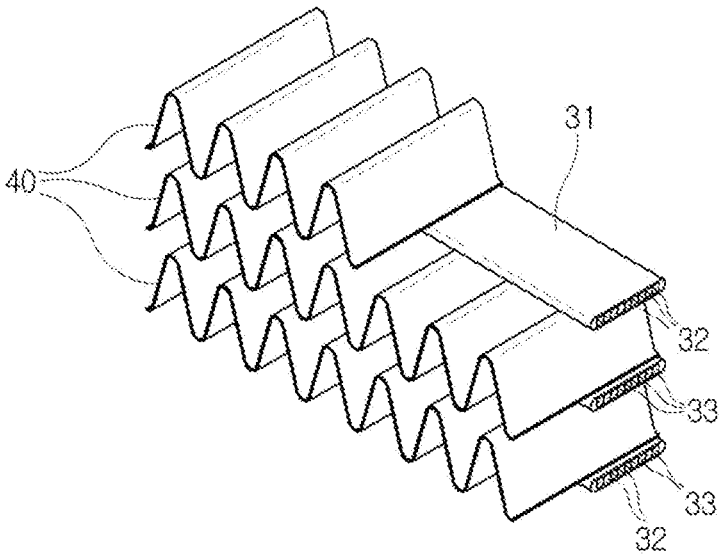
FIG. 2 is a perspective view showing a tube unit and fin structures included in the condenser for refrigerator according to the present invention.
Figure 3:
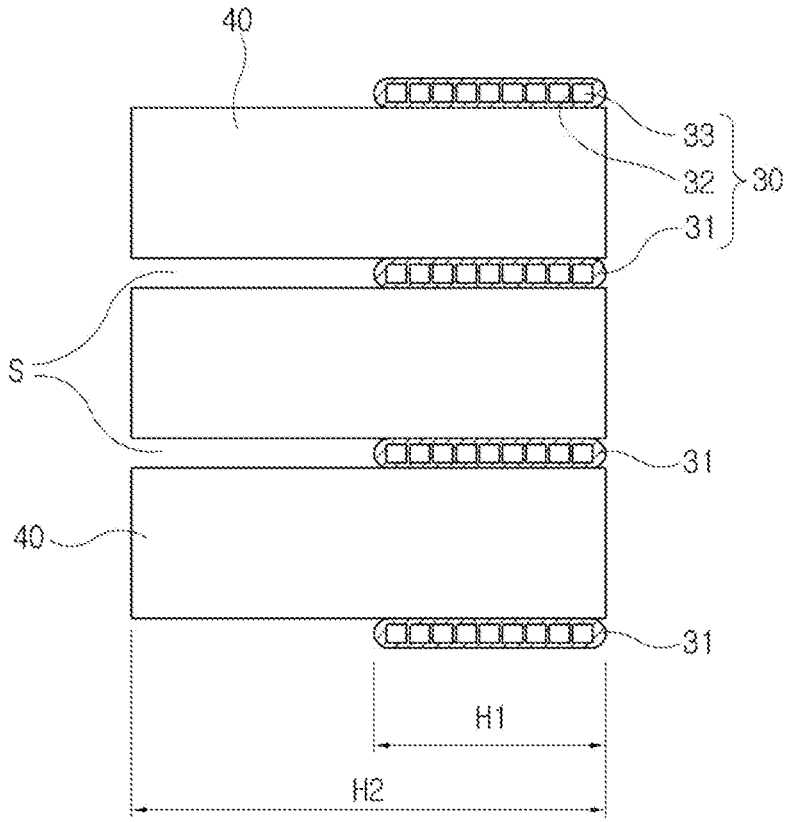
FIGS. 3 and 4 are respectively a side view and a front view showing the tube unit and the fin structures included in the condenser for refrigerator according to the present invention.
Figure 4:
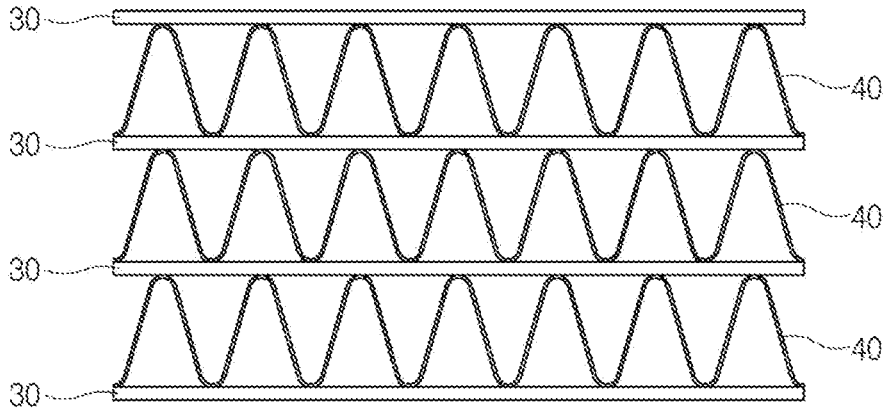

Explaining a configuration of the present invention below with reference to the accompanying drawings, FIG. 1 is a perspective view showing a condenser for refrigerator according to the present invention, FIG. 2 is a perspective view showing a tube unit and fin structures included in the condenser for refrigerator according to the present invention, and FIGS. 3 and 4 are respectively a side view and a front view showing the tube unit and the fin structures included in the condenser for refrigerator according to the present invention.

The condenser for refrigerator according to the present invention, designated by reference numeral 10, serves as a condenser or evaporator usable with refrigerators. The condenser 10 includes left and right headers 20 spaced apart from each other by a distance, a tube unit 30 and fin structures 40 mounted between the left header 20 and the right header 20, and one or more support members 50 to secure the tube unit 30 and the fin structures 40 to a base panel 60.

The headers 20, as exemplarily shown in FIG. 1, are vertically disposed on the base panel 60 with a given distance therebetween, and the tube unit 30 is mounted in a space defined between the headers 20.

Each of the headers 20 is provided at one side thereof for connection to the tube unit 30 with a plurality of insertion holes 21. As such, tubes 31 constituting the tube unit 30 may be inserted respectively into the insertion holes 21. In this case, the insertion holes 21 are spaced apart from one another by a constant distance in a vertical direction of the header 20.

While the headers 20 are mounted respectively at both sides of the tube unit 30, one of the headers 20 has an inlet port 22 and an outlet port 23 for introduction or discharge of refrigerant into or from the tubes 31, and the other header 20 functions to circulate the refrigerant through the tubes 31.

In this case, it should be noted that the inlet port 22 and the outlet port 23 may be provided respectively at the different headers 20 rather than being provided at the same header 20.

The tube unit 30, which is mounted between the header 20 and the header 20, has a prescribed length, and both ends of the respective tubes 31 are inserted into the insertion holes 21 of both the headers 20.

In this case, the tubes 31 are vertically spaced apart from one another by the same distance as the distance between the insertion holes 21 formed in the headers 20.

That is, the tubes 31 constituting the tube unit 30 may be vertically spaced apart from one another and the fin structures 40 may be mounted respectively in spaces S between the respective neighboring tubes 31.

As exemplarily shown in FIGS. 2 and 3, each of the tubes 31 is provided with a plurality of membranes 32 to prevent refrigerant from being gathered and moving only in a lower region of the tube 31. As such, a plurality of transfer paths 33 is defined between the respective neighboring membranes 32.

That is, the tube 31, which defines the transfer paths 33 therein, may function to prevent refrigerant from being gathered in a lower region of the tube 31.

The fin structures 40, which are placed between the header 20 and the header 20, have a prescribed length. As exemplarily shown in FIGS. 1 to 4, the fin structures 40 are located between the header 20 and the header 20 and mounted in the spaces S between the respective neighboring tubes 31 vertically spaced apart from one another.

In addition, each of the fin structures 40 is shaped in a zigzag manner to come into contact with the tubes 31 located above and below the fin structure 40.

More specifically, the fin structure 40 is constructed by combining fins having a triangular cross section in a zigzag manner, and upper and lower pointed portions of the zigzag-shaped fin structure 40 come into contact with lower and upper surfaces of the tubes 31 located above and below the fin structure 40. With this configuration, as heat of the refrigerant moving in the tubes 31 is conducted to the fin structure 40, the fin structure 40 performs heat exchange between the heat of the refrigerant conducted thereto and air around the fin structure 40.

To explain about additional with reference to FIG. 1, the headers 20 are vertically installed, the tubes 31 are vertically arranged between the header 20 and the header 20, and the fin structures 40 are mounted between the respective neighboring tubes 31, whereby heat exchange between the refrigerant inside the tubes 31 and air moving from the front to the rear may be accomplished.

In addition, the fin structures 40, as exemplarily shown in FIGS. 2 to 4, are configured to protrude from one side of the tubes 31. That is, the fin structures 40 have a greater width H2 than a width H1 of the tubes 31 so as to protrude from one side of the tubes 31, which may result in an expanded heat exchange range and higher heat exchange efficiency.

That is, the fin structures 40 have a sufficient width H2 to protrude from one side or any one of both sides of the tubes 31.

To explain about additional, a greater width H2 of the fin structures 40 causes a reduction in the number of fins (i.e. the number of bent portions of fins) as represented by the following Equation 1. As such, the volume of spaces between the bent (corrugated) fins increases, which enables smooth movement of air, thus resulting in protection against trapping of dust and debris and enhancement in heat exchange efficiency.

$$FRI = \frac{\text{Number of fin}}{\text{1 inch}} \qquad \text{Equation 1}$$

The support members 50 to secure the tube unit 30 and the fin structures 40 have a prescribed height and width.

In one embodiment of the present invention, the support members 50 may be fabricated by bending a plate having a prescribed thickness and width into an L-shaped form. These support members 50 may be horizontally spaced apart from each other by a given distance and then connected, at upper ends thereof, to lower ends of the tube unit 30 and the fin structures 40 and, at lower ends thereof, to the base panel 60. As such, the support members 50 serve to secure all of the headers 20, the tube unit 30 and the fin structures 40 to the base panel 60 while supporting them.

Here, it should be noted that the support members 50 may be welded to the base panel 60 or be fixed to the base panel 60 via various other fastening members, such as bolts, nuts, and the like.

The base panel 60, to which the support members 50 are coupled, has a prescribed size and thickness.

In this case, it should be noted that the base panel 60 may have any of various shapes to ensure that the base panel 60 is fixed to a refrigerator using fixing members (not shown), such as bolts, and the like.

That is, the base panel 60 is configured to be mounted to an air conditioning product, such as a refrigerator or the like, while supporting the headers 20, the tube unit 30 and the fin structures 40 via the support members 50.

The condenser 10 according to other embodiments of the present invention may be configured as exemplarily shown in FIGS. 5 to 10.

The condenser 10 may include headers 20*a*, a U-shaped tube unit 30*a*, U-shaped fin structures 40*a*, support members 50*a* to secure the tube unit 30*a* and the fin structures 40*a* to a base panel 60*a*, and a blowing fan 70*a*.

That is, in the condenser 10, the U-shaped tube unit 30*a* and the U-shaped fin structures 40*a* may achieve higher space utilization as well as higher heat exchange efficiency.

Here, the condenser 10 has components corresponding to those of FIGS. 1 to 4 and these overlapping components will be described below in brief.

The condenser 10 includes the headers 20 into or from which refrigerant is introduced or discharged, the tube unit 30*a* including a plurality of tubes 31*a* connected at both ends thereof to the headers 20*a* to be in communication with the headers 20*a*, the tubes 31*a* being spaced apart from one another in a longitudinal direction of the headers 20*a* and being in communication with one another, the fin structures 40*a* mounted in spaces S between the respective neighboring tubes 31*a* constituting the tube unit 30*a*, the fin structures 40*a* having longitudinally and successively arranged corrugated fins.

While the headers 20*a* are mounted respectively at both sides of the tube unit 30*a*, one of the headers 20*a* has an inlet port 22*a* and an outlet port 23*a* for introduction or discharge of refrigerant into or from the tubes 31*a*, and the other header 20*a* functions to circulate the refrigerant through the tubes 31*a*.

That is, when refrigerant is introduced into one header 20*a* provided with the inlet port 22*a* and the outlet port 23*a*, the refrigerant is cooled while passing through the tubes 31*a* that are in communication with the corresponding header 20*a* and, thereafter, is discharged from the outlet port 23*a* of the corresponding header 20*a* by way of the other header 20*a*.

In the case of the condenser 10 as described above, a combination of the tube unit 30*a* and the fin structures 40*a*, located between the header 20*a* and the header 20*a*, has a U-shaped form to define an empty space 24*a* between both ends thereof.

In addition, in the condenser 10, the U-shaped tubes 31*a* and the U-shaped fin structures 40*a* are stacked one above another on an upper surface of the base panel 60*a* so as to mutually correspond to each other.

Figure 5:
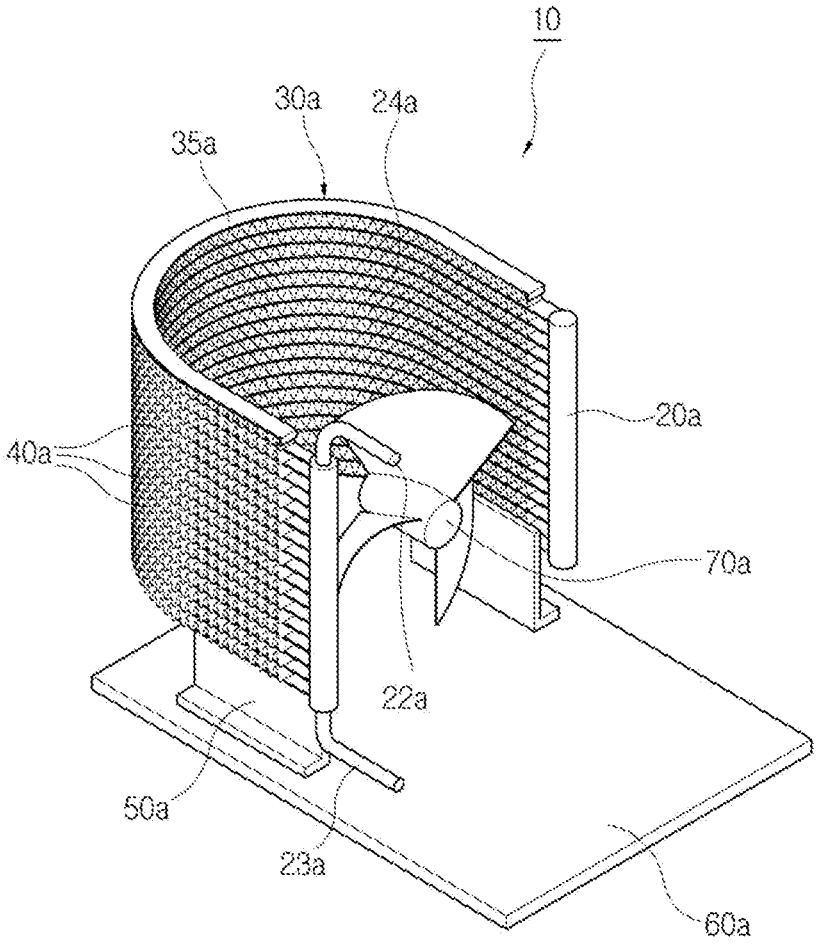
FIG. 5 is a perspective view showing another embodiment of the condenser for refrigerator according to the present invention.
Figure 6:
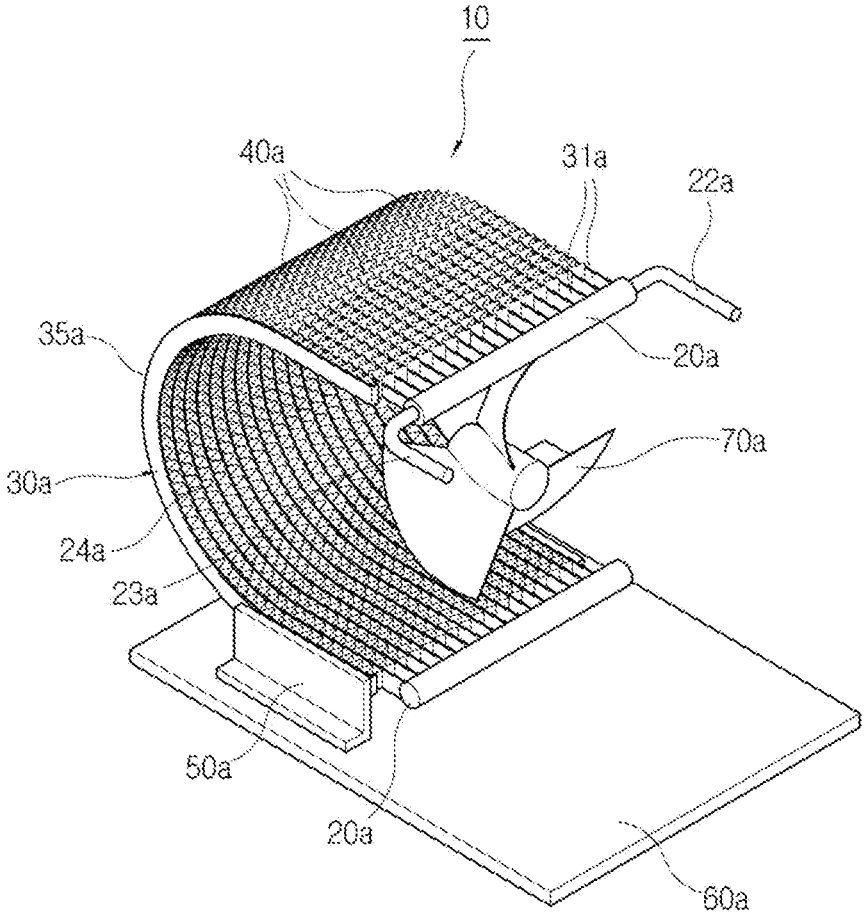
FIG. 6 is a perspective view showing a further embodiment of the condenser for refrigerator according to the present invention.

Considering this configuration in more detail, when viewing the condenser 10 from the top of the base panel 60*a*, the condenser 10 may have a U-shaped form rotated to the left or right by 90 degrees as exemplarily shown in FIG. 5. Alternatively, as exemplarily shown in FIG. 6, the U-shaped tube unit 30*a* and the U-shaped fin structures 40*a* may be successively arranged on the upper surface of the base panel 60*a* so as to lie on their side in a width direction of the base panel 60*a*. As such, the condenser 10 shown in FIG. 6 may have a U-shaped form rotated to the left or right by 90 degrees when viewed from the front thereof.

Figure 8A:
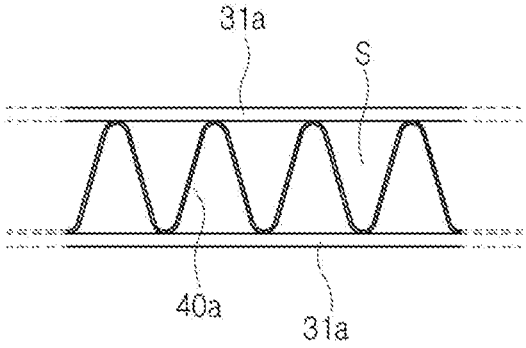
FIGS. 8(*a*) and 8(*b*) are views showing different examples of a tube unit and a fin structure which may be applied to the condenser for refrigerator of FIGS. 5 and 6 according to the present invention.
Figure 8B:
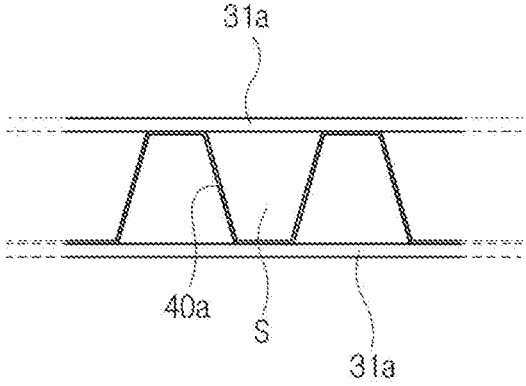

In addition, in the case in which the fin structures 40*a* have longitudinally and successively corrugated fins and are mounted in the spaces S between the respective neighboring tubes 31*a* so as to be stacked one above another, the corrugated fins of the fin structures 40*a* may have a triangular shape as exemplarily shown in FIG. 8(*a*), or may have a truncated triangular shape acquired by horizontally flattening a pointed triangular end as exemplarily shown in FIG. 8(*b*).

In this case, a pitch P of the corrugated fins of the fin structures 40*a* is within a range of 2 mm to 10 mm, which may effectively prevent trapping of dust between the fins.

The support members 50*a* serve to install the headers 20*a*, the tube unit 30*a* and the fin structures 40*a* as described above and, more particularly, secure the headers 20*a*, the tube unit 30*a* and the fin structures 40*a* to the upper surface of the base panel 60*a*.

That is, the support members 50*a* are mounted on the base panel 60*a* and, in turn, the headers 20*a*, the tube unit 30*a* and the fin structures 40*a* are secured to upper ends of the support members 50*a*.

In embodiments, contact regions between the support members 50*a* and the base panel 60*a* and between the support members 50*a* and the headers 20*a*, the tube unit 30*a* and the fin structures 40*a* may be subjected to welding or fastening using various fixing means (bolts, nuts, pins, and the like).

Figure 9A:
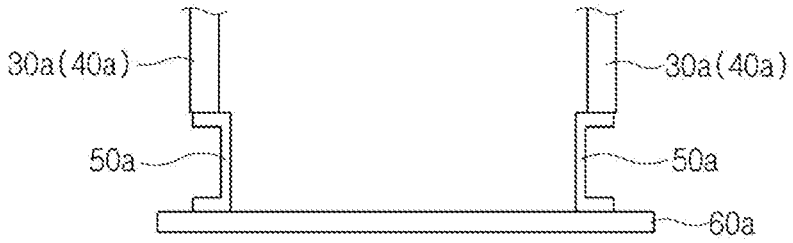
FIGS. 9(*a*) and 9(*b*) are views showing different coupling configurations of a support member which may be applied to the condenser for refrigerator of FIGS. 5 and 6 according to the present invention.
Figure 9B:
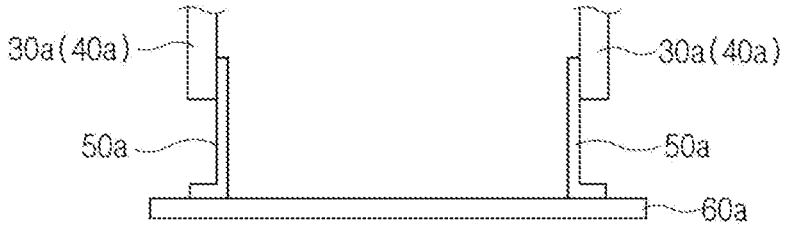

In addition, while the headers 20*a*, the tube unit 30*a* and the fin structures 40*a* may be disposed on and coupled to upper surfaces of the support members 50*a* as exemplarily shown in FIG. 9(*a*), the support members 50*a* may be secured to lateral surfaces of the tube unit 30*a* and the fin structures 40*a* as exemplarily shown in FIG. 9(*b*). Accordingly, it should be noted that coupling positions of the support members 50*a* may be altered in various ways so long as the support members 50*a* serve to secure the headers 20*a*, the tube unit 30*a* and the fin structures 40*a* to the base panel 60*a*.

In addition, it should be noted that, for stable coupling of the headers 20*a*, the tube unit 30*a* and the fin structures 40*a*, the number of the support members 50*a* may be altered according to circumstance.

The blowing fan 70*a*, which serves to blow air to the tube unit 30*a* and the fin structures 40*a*, is mounted on the upper surface of the base panel 60*a* and performs air cooling of refrigerant passing through the headers 20*a*, the tube unit 30*a* and the fin structures 40*a*.

Here, it is effective that the blowing fan 70*a* is fixedly mounted on the base panel 60*a* to blow air toward the headers 20*a*, the tube unit 30*a* and the corrugated fins of the fin structures 40*a*.

Figure 7A:
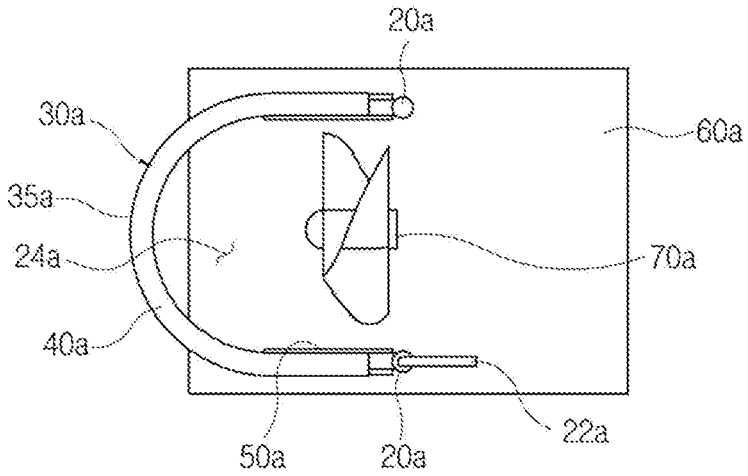
FIGS. 7(*a*) and 7(*b*) are plan views showing different installation examples of a blowing fan usable with the condenser for refrigerator of FIGS. 5 and 6 according to the present invention.
Figure 7B:
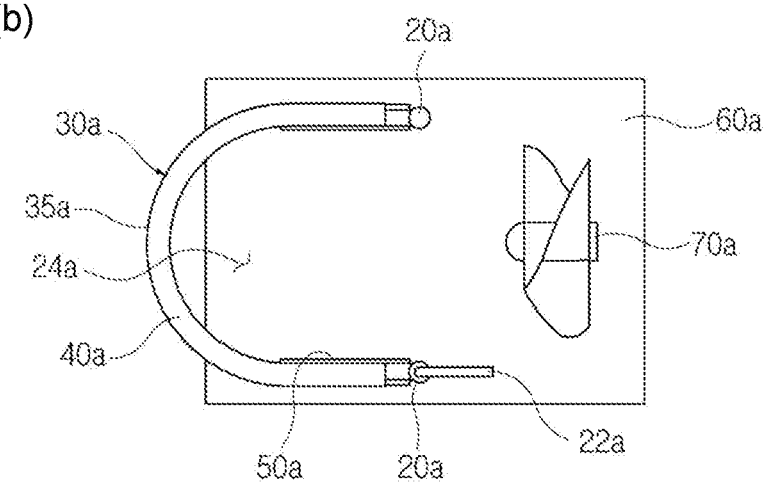

In addition, the blowing fan 70*a* may be located in the empty space 24*a* defined by an U-shaped combination of the headers 20*a*, the tube unit 30*a* and the fin structures 40*a* as exemplarily shown in FIG. 7(*a*), or may be spaced apart from one side of the headers 20*a*, the tube unit 30*a* and the fin structures 40*a* arranged on the base panel 60*a* as exemplarily shown in FIG. 7(*b*).

Next, use of the condenser 10 having the above-described configuration will be described. The condenser 10 is mounted in a machine room M that is defined in a rear bottom region of a refrigerator R.

With regard to the machine room M of the related art, a cover is additionally installed to conceal the interior of the machine room M and provided with slits for discharge of hot air generated from the condenser 10 and various other electric devices in the machine room M.

Figure 10:
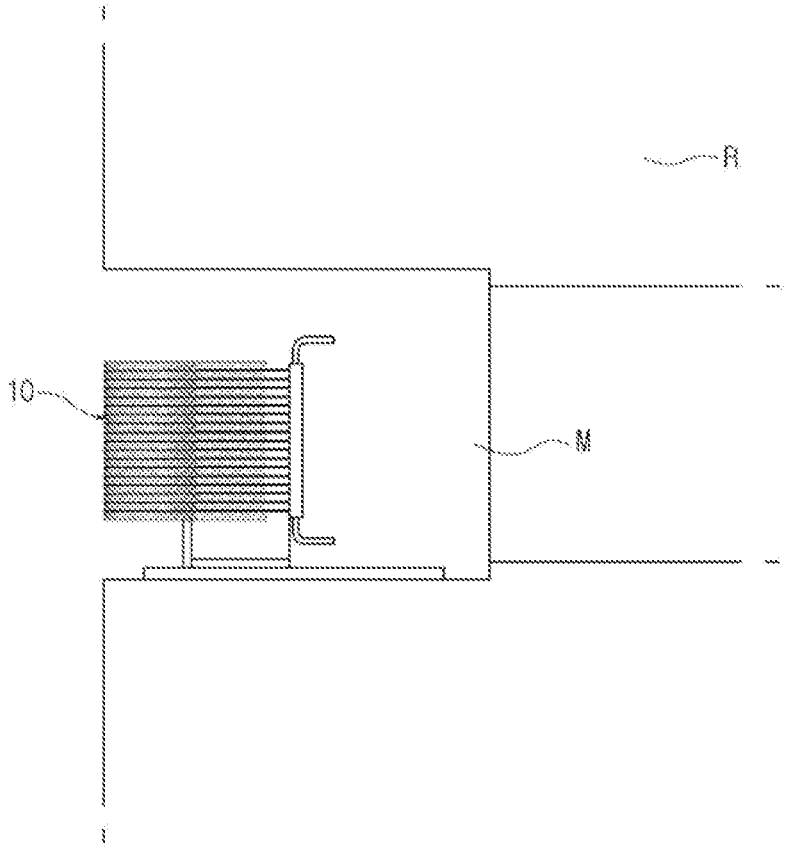
FIG. 10 is a view showing an installed state of the condenser for refrigerator of FIGS. 5 and 6 according to the present invention.

Differently from the related art, in the present invention, owing to the headers 20*a*, the tube unit 30*a* and the fin structures 40*a* constructing a U-shaped combination, as exemplarily shown in FIG. 10, the condenser 10 is mounted in the machine room M in such a way that an outer circumferential surface (i.e. a surface not facing the blowing fan 70*a*) of a curved region 35*a* of the U-shaped combination constructed by the headers 20*a*, the tube unit 30*a* and the fin structures 40*a* is visible from the outside when viewed from the back of the refrigerator R.

That is, even if no cover is installed to the machine room M in which the condenser is mounted, the condenser may prevent the interior of the machine room M from being easily viewed from the outside.

To explain about additional, in the present invention, as the machine room M is not provided with a cover, heat generated by the condenser and other devices inside the machine room M may be efficiently radiated from the refrigerator R.

In addition, since the headers 20*a*, the tube unit 30*a* and the fin structures 40*a* are not shielded by a cover, the headers 20*a*, the tube unit 30*a* and the fin structures 40*a* do not trap dust due to a pitch P of fins of the fin structures 40*a*.

As is apparent from the above description, in a condenser according to the present invention, fins of fin structures have a greater width than a width of tubes constituting a tube unit, which may result in an expanded heat exchange range and higher heat exchange efficiency. In addition, wider gaps between corrugated fins ensure smooth air movement, thus causing a reduced pressure difference of the moving air and neither dust nor debris is trapped between the fins, resulting in enhancement in heat exchange efficiency.

In addition, providing the tube unit and the fin structures with a U-shaped form may ensure installation of the condenser within a limited space and higher heat exchange efficiency. Moreover, this U-shaped form gives the condenser an aesthetically pleasing outer appearance, facilitating outwardly revealed installation of the condenser, and contributes to realization of a dust proofing fin pitch configuration.

Although the condenser according to the present invention has been described above based on specific shapes and directions with reference to the accompanying drawings, various modifications, additions and substitutions of the present invention are possible by those skilled in the art, and these modifications, additions and substitutions should be construed as being included in the technical spirit of the present invention.

What is claimed is:

1. A condenser for a refrigerator comprising:

left and right or upper and lower headers spaced apart from each other;

a tube unit including tubes mounted between the headers and spaced apart from one another, the tubes serving to transfer refrigerant introduced or discharged through the headers; and a fin structure mounted in between the tubes to perform heat exchange between the refrigerant transferred through the tubes and outside air, the fin structure including fins having a greater width than a width of the tubes, wherein the tube unit and the fin structure respectively have a U-shaped form, wherein the tube unit and the fin structure define an inner space and an outer space and a blowing fan is located in the inner space, wherein the blowing fan serves to blow air to the tube unit and the fin structure, wherein the fin structure is protruded from the end of the tubes to the outer space, wherein the fin structure is not protruded from the other end of the tubes to the inner space, wherein the protruded region of the fin structure guides the flow of the air generated by the blowing fan and passed through the space between the fin structure and the tubes, and wherein the fin structure between the tubes is longitudinally corrugated and has a pitch within a range of 2 mm to 10 mm to prevent trapping of dust.

2. The condenser for the refrigerator according to claim 1, wherein the tube unit and the fin structure are supported by a plurality of support members located at a lower end of the tube unit, and the support members are disposed on a base panel.

3. The condenser for the refrigerator according to claim 1, wherein each of the tubes defines a plurality of transfer paths inside each of the tubes.

4. The condenser for the refrigerator according to claim 1, wherein the tubes of the tube unit and the fins of the fin structure are vertically and horizontally stacked one above another.

* * * * *